US007264690B2

(12) United States Patent
Cheng

(10) Patent No.: US 7,264,690 B2
(45) Date of Patent: Sep. 4, 2007

(54) CATALYZER FOR CLEAN PULPING AND PROCESS FOR USING THE SAME

(76) Inventor: Xiang Wu Cheng, No. 1706 High Technology Building, No. 229 North Si Huan Zhong Road, Beijing, 100083 (CN)

( * ) Notice: Subject to any disclaimer, the term of this patent is extended or adjusted under 35 U.S.C. 154(b) by 9 days.

(21) Appl. No.: 10/537,841

(22) PCT Filed: Nov. 29, 2004

(86) PCT No.: PCT/CN2004/001371

§ 371 (c)(1),
(2), (4) Date: Jun. 6, 2005

(87) PCT Pub. No.: WO2005/052247

PCT Pub. Date: Jun. 9, 2005

(65) Prior Publication Data

US 2006/0060315 A1 Mar. 23, 2006

(30) Foreign Application Priority Data

Nov. 28, 2003 (CN) ..... 2003 1 0115531 A

(51) Int. Cl.

| | |
|---|---|
| ***D21C 3/18*** | (2006.01) |
| ***D21B 1/16*** | (2006.01) |
| ***D06L 3/06*** | (2006.01) |
| ***B01J 31/00*** | (2006.01) |

(52) U.S. Cl. ..... 162/24; 162/9; 162/26; 162/87; 162/99; 8/108.1; 8/110; 252/188.21; 502/172

(58) Field of Classification Search ..... 162/24, 162/85, DIG. 5, 9, 26, 87, 99; 8/108.1, 110; 252/188.21; 502/172

See application file for complete search history.

(56) References Cited

U.S. PATENT DOCUMENTS

| | | | | |
|---|---|---|---|---|
| 1,730,387 | A * | 10/1929 | Schur et al. | 536/37 |
| 1,768,823 | A * | 7/1930 | Bradley et al. | 162/78 |
| 1,847,311 | A * | 3/1932 | Schur et al. | 162/19 |
| 1,971,241 | A * | 8/1934 | Weitxel et al. | 162/59 |
| 2,016,067 | A * | 10/1935 | Bannister | 175/103 |
| 2,040,430 | A * | 5/1936 | Crocker et al. | 554/6 |
| 2,388,592 | A * | 11/1945 | Asplund et al. | 162/23 |
| 3,767,586 | A * | 10/1973 | Rutkiewic | 252/186.34 |
| 3,769,152 | A * | 10/1973 | Samuelson et al. | 162/65 |
| 4,764,252 | A * | 8/1988 | Shin et al. | 162/72 |
| 5,133,834 | A * | 7/1992 | Capps | 162/84 |
| 5,366,594 | A * | 11/1994 | Capps | 162/84 |
| 5,597,714 | A * | 1/1997 | Farone et al. | 435/100 |
| 5,944,953 | A * | 8/1999 | Lavoie et al. | 162/96 |
| 6,258,207 | B1 * | 7/2001 | Pan | 162/27 |
| 2004/0256065 | A1 * | 12/2004 | Ahmed et al. | 162/26 |

FOREIGN PATENT DOCUMENTS

| | | |
|---|---|---|
| CN | 1071476 | 4/1993 |
| CN | 1264771 | 8/2000 |
| CN | 1292445 | 4/2001 |
| CN | 136646 | 7/2002 |

* cited by examiner

*Primary Examiner*—Steven P. Griffin
*Assistant Examiner*—Dennis R. Cordray

(57) ABSTRACT

A catalyzer for clean pulping includes sodium salicylate, anion silicate softener, cooking aids, liquid(gaseous) chlorine and water. A process for using the catalyzer for clean pulping includes the following steps: 1, cutting and impurities removing for the raw material, 2, feed preparation and impurities removing, 3, dividing into fibers by refining, 4, catalysis copolymerization, 5, refining, 6, concentration and separation, 7, pulp bleaching, 8, pulp washing and 9, finished pulp. The present invention realizes the clean production; it does not need to digest and does not produce black liquor; the process is simple and is performed at normal temperature; the resource of crops is fully used; the effect of water conservation is remarkable; it is very easy to control each stage separately and/or simultaneously.

6 Claims, No Drawings

CATALYZER FOR CLEAN PULPING AND PROCESS FOR USING THE SAME

This application is a 371 of PCT/CN04/01371, filed Nov. 29, 2004 which claims priority of Chinese Patent Application 200310115531.7, filed Nov. 28, 2003.

TECHNICAL FIELD

The present invention relates to a catalyzer and process for using the same. In particular, it relates to a catalyzer for clean pulping and process for using the same.

BACKGROUND ART

Paper-making with straw is popular in our country, while it is mainly made from wood pulp at abroad. In a long run, non-wood fiber is used as the main raw material in our country's paper-making industry and straw pulp accounts for 80% of the raw material of paper-making. Especially in the provinces in the north of China, the resource of wheat straw is rich and its price is low, which become our superiority to make paper with straw. At present, the main processes to make pulp from straw are soda process, sulfate process, ammonia process and so on. Among them sodium hydroxide process is the process in common use. The fatal defects of conventional pulping technology are to produce large volume of black liquor which pollutes environment seriously and is very difficult to treatment. Many domestic and foreign experts intend to solve this problem for years, but fail to find a satisfied solution. At present, a well-known solution is to recover sodium hydroxide. However, the initial investment for sodium hydroxide recovering is too big for common enterprise to bear. Moreover, this process can not solve the problem completely yet.

DISCLOSURE OF INVENTION

The object of the present invention is to overcome the drawbacks of the prior art and to provide a catalyzer for clean pulping and process for using the same.

The solution of the present invention is shown as the following:

The composition(wt. %) of a catalyzer for pulping including:

sodium salicylate: 5%-9%; anion silicic acid softener: 2%-5%; cooking aids: 3%-7%; liquid chlorine or gaseous chlorine: 2.1%-3.7%; the remaining: water; Wherein said cooking aids includes: hydrone volatile: ethanol and/or ether: 0.01-5%; free quinone: concentrated sulfuric acid and/or carbon tetrachloride: 0.25-35%; active matter: basic $Na_2SO_3$: 0.15-30%; the remaining: water.

Wherein sodium salicylate functions as permeation; anion silicic acid softener functions as softening the raw materials.

Said cooking aids is the solution which is the mixture of the emulsion with the concentration of 3% and pure water, wherein said emulsion is formed of the raw material of cooking aids.

Below is the process of manufacturing the catalyzer of the present invention.

All of the above mentioned raw materials are added to the reacting vessel. After mixing for 3.5-5.5 hours, the catalyzer for clean pulping according to the present invention can be obtained. It is a nontoxic, odorless, non-corrosive liquid.

In the state of normal temperature and pressure, the catalyzer for clean pulping according to the present invention can perform the soaking and catalyzing process to the raw materials which are cut into pieces and removed the impurities. Because copolymerization reaction is produced, Fibrous performance of the raw material is changed from microscopic view. After being rinsed, the pulp which could be used to make paper can be produced. All kinds of herbs can be used as the raw materials of the present invention, such as straw stem, including wheat straw, rice straw, corn stalk, cotton straw or reed. Due to the abound resource, low price, wheat straw becomes the preferred raw material.

The process of using the catalyzer for clean pulping according to the present invention is:

Raw material→cutting and impurities removing→feed preparation and impurities removing→dividing into fibers by refining→catalysis copolymerization→refining→concentration and separation→bleaching pulp→washing pulp→finished pulp Below is the detailed description:

1. Cutting and Impurities Removing:

Because the purchased raw material of wheat straw includes remaining kernels and ears, which affect the quality of pulp, and result in insufficient bleaching, there are defects, so called "white point" and "yellow point" in the paper. Thus, impurities removing is necessary. This process is to soak raw material in the catalyzer, so the specific surface area is the key point to impact the process. The thinner raw material is refined, the larger specific surface area is soaked, the larger the area between raw material and catalyzer is contacted, and the more effect the soaking and catalytic treatment becomes. Therefore, the raw material must be cut. The conventional equipment for cutting and impurities removing can be used for the present invention. After being cut and removed impurities, the average length of the treated wheat straw is between 10 mm and 15 mm. Due to the different density between wheat straw and other impurities, the remaining fringe, kernel as well as dust can be separated through a gravity separator. The removal rate of the impurities is above 95%.

2. Feed Preparation and Impurities Removing:

The pretreatment is proceeded to the cut and removed raw material, that is, the raw material is soaked in the catalyzer to prepare so that the catalyzer is mixed with raw material uniformly, at the same time, further dust and impurities removing is performed. The conventional technologies for mixing, dust and impurities removing can be used for present invention. The dry weight of raw material (air dried raw material) is 3-8% of catalyzer weight. The time for preparation is 10-14 hours. A deposition channel is provided at the bottom of the bath for feed preparation and impurities removing. Using the principle of different density among different impurities(such as dust, fritter, remaining fringe and kernel), the deposition and impurities removing treatment is performed. By passing through the bath for feed preparation and impurities removing, the purity of wheat straw is higher, and the effect of later processing is better.

3. Dividing Into Fibers by Refining:

After the feed preparation and impurities removing, the wheat straw is divided into fibers through the refining disc in the conventional pulping process. The raw material pieces with 10-15 mm are divided into rough fiber bundle to increase the specific surface area for catalysis.

4. Catalysis Copolymerization:

The original straw pulp which is subjected to the above mentioned steps enters into catalysis tower to perform catalysis copolymerization reaction. At the normal temperature and pressure, catalyzer catalyzes wheat straw fibre to perform copolymerization reaction. The reaction can be completed in 10-14 hours. The catalyzer is filled between the fibres of wheat straw. Furthermore, it is very easy to make the separation in the later processing and form the final pulp.

5. Refining:

After the wheat straw pulp is subjected to catalysis copolymerization reaction, the pulp has satisfied the requirements of papermaking stock except the fibrous thickness and length. Therefore, the pulp must be grounded into the required papermaking stock through conventional refiner (refining disc) According to the specification of the different papermaking pulp, the different papermaking pulp with different performance can be obtained by arranging different slotted screen.

6. Concentration and Separation:

In the papermaking pulp which completes catalysis copolymerization reaction in the catalysis tower, the concentration of pulp is 2.5-3%, about 97% is catalyzer which does not react completely. In order to reduce the cost of systems operation, the pulp and catalyzer are separated by conventional pulp thickener. So the separated papermaking stock with different concentration may be obtained according to the requests, while the residual liquor of the catalyzer is recovered.

7. Pulp Bleaching:

At ordinary temperature, the bleaching is proceeded by the conventional bleaching equipment so as to make the whiteness of pulp meet requirements.

8. Pulp Washing:

The bleached pulp is washed in the conventional pulp washing vessel, then the finished pulp is obtained.

PREFERRED EMBODIMENTS

EXAMPLE 1

The composition(wt. %) of a catalyzer for clean pulping according to the present invention including:

sodium salicylate: 5%; anion silicic acid softener: 2%; cooking aids: 3%; liquid(gaseous) chlorine: 2.1%; the remaining: water;

wherein said cooking aids includes: hydrone volatile including ethanol and/or ether: 0.01%; free quinone: concentrated sulfuric acid and/or carbon tetrachloride: 0.25%; active matter: basic $Na_2SO_3$: 0.15%, the remaining: water.

Said cooking aids is the solution which is the mixture of the emulsion with the concentration of 3% and pure water, wherein said emulsion is formed of the raw material of cooking aids.

All of the above mentioned raw material are added to the reacting vessel. After mixing for 3.5 hours, the catalyzer for the clean pulping according to the present invention can be obtained.

EXAMPLE 2

The composition(wt. %) of a catalyzer for the clean pulping according to the present invention including:

sodium salicylate: 9%; anion silicic acid softener: 5%; cooking aids: 7%; liquid(gaseous) chlorine: 3.7%; the remaining: water; wherein said cooking aids includes: hydrone volatile including ethanol and/or ether: 5%; free quinone: concentrated sulfuric acid and/or carbon tetrachloride: 35%; active matter: basic $Na_2SO_3$: 30%, the remaining: water.

Said cooking aids is the solution which is the mixture of the emulsion with concentration of 3% and pure water, wherein said cooking aids is formed of the raw material of cooking aids.

All of the above mentioned raw material are added to the reacting vessel. After mixing for 4 hours, the catalyzer for the clean pulping according to the present invention can be obtained.

EXAMPLE 3

The composition(wt. %) of a catalyzer for pulping according to the present invention including:

sodium salicylate: 6%; anion silicic acid softener: 3%; cooking aids: 4%; liquid(gaseous) chlorine: 2.9%; the remaining: water;

wherein said cooking aids includes: hydrone volatile including ethanol and/or ether: 3%; free quinone: concentrated sulfuric acid and/or carbon tetrachloride: 30%; active matter: basic $Na_2SO_3$: 25%, the remaining water.

Said cooking aids is the solution which is the mixture of the emulsion with concentration of 3% and pure water, wherein said cooking aids is formed of the raw material of cooking aids.

All of the above mentioned raw material are added to the reacting vessel. After mixing for 5 hours, the catalyzer for pulping according to the present invention can be obtained.

EXAMPLE 4

Below is the detailed clean process for using catalyzer for the clean pulping according to the present invention:

1. Cutting and Impurities Removing:

The conventional equipment for cutting and impurities removing can be used for the present invention. After being cut and removed impurities, the average length of the treated wheat straw is between 10 mm and 15 mm. The remaining fringe, kernel as well as dust can be separated through a gravity separator and their removal rate is above 95%.

2. Feed Preparation and Impurities Removing:

Following the step of cutting and impurities removing, the wheat straw is soaked in the catalyzer to mix the catalyzer with raw material uniformly so as to complete feed preparation. The dry weight of the wheat straw is 3% of catalyzer weight and the time for feed preparation is 14 hours. A deposition channel is provided at the bottom of the bath for the feed preparation and impurities removing. Using the principle of different density among different impurities (such as dust, fritter, remaining fringe and kernel), the deposition and impurities removing treatment is performed. In order to make sure that the wheat straw is mixed with catalyzer completely to achieve the target of the feed preparation, a submerged mesh is arranged on the bath for feed preparation and impurities removing, which has the function to keep the floating wheat straw under the liquid level of catalyzer.

3. Dividing Into Fibers by Refining:

After the feed preparation and impurities removing, the wheat straw is divided into fibers by refining through the refining disc in the conventional pulping process. The raw material piece with 10-15 mm is divided into rough fiber bundle by this step to increase the specific surface area for catalysis.

4. Catalysis Copolymerization:

The straw pulp which is subjected to the above mentioned steps enters into catalysis tower to perform catalysis copolymerization reaction. At the normal temperature and pressure, catalyzer catalyzes wheat straw fibres to perform copolymerization reaction, which lasts 14 hours.

5. Refining:

The above-mentioned pulp is ground into the required papermaking stock through conventional refiner(refining disc). According to the requirement of the different papermaking pulp, the different papermaking pulp with different performance can be obtained by arranging different slotted screens.

6. Concentration and Separation:

In order to reduce the cost of systems operation, the pulp and catalyzer are separated by a conventional thickener for papermaking pulp so that the papermaking stock with different concentration may be separated according to the requests, while the residual liquor of catalyzer is recovered.

7. Pulp Bleaching:

At ordinary temperature, the concentrated pulp is diluted to the concentration of 3% (mass %) with bleaching liquor. The bleaching is proceeded for 1.5 hours by conventional bleaching equipment so as to make the whiteness of pulp meet requirements. In order to ensure the bleaching effect, calcium hypochlorite is used for bleaching liquor. Also, the supplying port of chlorine gas is added at the recycle entrance of fan pump, through which the chlorine gas is added intermittently during the bleaching to increase the available chlorine in the whole bleaching liquor. So the available content of bleaching liquor can remain constant during the whole bleaching process. After the bleaching process, the remaining bleaching liquor in the bleaching liquor tower still has certain amount of the available chlorine. To reduce the cost of systems operation, the remaining bleaching liquor is concentrated by the concentrator and returned to the bleaching liquor tower for recycling.

8. Pulp Washing:

The bleached pulp is washed in the conventional bath for pulp washing. At ordinary temperature, the pulp is diluted to 3% with clean water; the pulp is washed through the circulation of the conventional pulp pump; separation between pulp and water is made by concentrator; the separated pulp is washed again; the separated water enters into collection bath and it can be reused for the pulp washing again after final treatment. Being washed 3 times, the finished pulp can be obtained.

The reaction vessels used for the whole process, such as reaction vessel and catalysis tower, should be anticorrosive. Equipments made of glass, ceramics, plastic, etc., can be used for the present invention.

The key technical factors of the final pulp is shown as follows:

| Whiteness | Wet weight | Beating degree | Dirt |
|---|---|---|---|
| 75.0% | 2.1 g | 36.0 SR | $mm^2$/500 g ≦ 60 |

The final pulp is made into writing paper according to the prior art. With the test, the main factors of said paper are shown as follows:

| | |
|---|---|
| Basis weight | 55.5 g/$m^2$ |
| Whiteness | 82% |
| breaking length | Vertical/horizontal 2.05/1.72<br>Average. 1.885 KM |

-continued

| | |
|---|---|
| Smoothness | South 25.1/19.3 North 24.2/17.6<br>Difference: 23.1% 27.2% |
| Folding endurance | 8 times |
| Degree of sizing | 0.75 mm |
| Water content | 6.2% |
| Ash content | 12.4% |

EXAMPLE 5

Below is the process for using the catalyzer for clean pulping according to the present invention.

The rice straw used as the raw material is soaked in the catalyzer for 10 hours to complete the feed preparation. The dry weight of the raw material is 8% of catalyzer weight. At the normal temperature and pressure, the pulp enters into the catalysis tower to proceed copolymerization reaction for 12 hours. Other steps are similar to that of example 4.

EXAMPLE 6

Below is the process for using the catalyzer for clean pulping according to the present invention.

The corn stalk used as the raw material is soaked in the catalyzer for 11 hours to complete the feed preparation. The dry weight of the raw material is 6% of catalyzer weight. At the normal temperature and pressure, the pulp enters into the catalysis tower to proceed copolymerization reaction for 11 hours. Other steps are similar to the steps of example 4.

EXAMPLE 7

Below is the process for using the catalyzer for clean pulping according to the present invention.

The cotton straw used as the raw material is soaked in the catalyzer for 13 hours to complete the feed preparation. The dry weight of the raw material is 4% of catalyzer weight. At the normal temperature and pressure, the pulp enters into the catalysis tower to proceed copolymerization reaction for 13 hours. Other steps are similar to the steps of example 4.

EXAMPLE 8

Below is the process for using the catalyzer for clean pulping according to the present invention.

The reed used as the raw material is soaked in the catalyzer for 10 hours to complete the feed preparation. The dry weight of the raw material is 7% of catalyzer weight. At the normal temperature and pressure, the pulp enters into the catalysis tower to proceed copolymerization reaction for 14 hours. Other steps are similar to the steps of example 4.

All kinds of herbs can be used as the raw material. The present invention is not limited to the examples disclosed.

INDUSTRIAL PRACTICABILITY

1. The main characteristic of the catalysis process for pulping according to present invention is to realize clean production. Said process overcomes a many shortcomings in other traditional processes. For example, it does not need to digest and does not produce black liquor, except a small amount of waste water (it can be recycled after simple treatment) produced in the pulp washing step, no draining is realized in the catalytic process and bleaching process. This is a significant breakthrough in the technology of pulp and paper. However, because the raw material is dry, while the pulp of the finished product is wet, the clean water should be supplied continuously during the production run.

2. The wheat straw is Catalyzed to form pulp at the normal temperature and pressure, this eliminates the potential safety hazard of high temperature, high pressure and cooker explosion and improves the workers' environment of production operation.

3. The pulping process of the present invention is so simple that the fixed investment and the running cost are much lower than the conventional pulping process with wheat straw through recovering sodium hydroxide. Also, the cost of pollution control is sharply reduced.

4. Due to the present invention, crop resource is fully used and trees are protected. In the meantime, not only the farmer's income is increased, but also the atmospheric pollution and the wasting of resources caused by straw incineration is prevented.

5. The pulp of the present invention is formed through catalysis process which does not produce black liquor and the pulp is easily bleached and rinsed. So this process has remarkable effect of water conservation. For example, the national standards for the conventional process stipulates that the water consumption for manufacturing 1 ton of paper should not be more than 240 tons. But the water consumption for manufacturing 1 ton of paper with the process of the present invention is below 60 tons, which is less 75% than the conventional process.

6. Due to multi-stage is adopted, it is very easy to control each stage separately and/or simultaneously.

We claim:

1. A catalyzer for clean non-woody pulping comprising:

5 wt %-9 wt % of sodium salicylate;

2 wt %-5 wt % of anion silicic acid;

3 wt %-7 wt % of cooking aids;

2.1 wt %-3.7 wt % of liquid chlorine or gaseous chlorine; and balance of water;

wherein said cooking aids includes:

0.01 wt %-5 wt % of ethanol and/or ether;

0.25 wt %-35 wt % of concentrated sulfuric acid and/or carbon tetrachloride;

0.15 wt %-30 wt % of basic $Na_2SO_3$; and balance of water.

2. A process for using the catalyzer for clean non-woody pulping according to claim 1, comprising the following steps:

a) cutting and impurities removing;

wherein a raw material is cut into pieces with the length of between 10 mm and 15 mm, the removal rate of remaining fringe, kernel as well as dust is above 95%;

b) feed preparation and impurities removing;

wherein the raw material is soaked in the catalyzer to prepare for 10-14 hours, the dry weight of the raw material is 3-8% of the weight of the catalyzer, deposition and impurities removing are proceeded through a deposition channel provided at bottom of a bath for the feed preparation and impurities removing;

c) dividing into fibers by refining;

wherein the raw material is divided into fibers through a refining disc so that it is changed to rough fiber bundle;

d) catalysis copolymerization;

wherein a pulp obtained from the above steps enters into a catalysis tower to perform catalysis copolymerization reaction for 10-14 hours;

e) refining;

wherein the pulp is ground into a papermaking stock through a refiner;

f) concentration and separation;

wherein the pulp and the catalyzer are separated by a thickener, the papermaking stock with different concentration is separated according to requirements, while residual liquor of the catalyzer is recovered;

g) pulp bleaching;

wherein bleaching is proceeded by a bleaching equipment to obtain a bleached pulp;

h) pulp washing; and wherein the bleached pulp is washed in a pulp washing vessel, then a finished pulp is obtained.

3. The process for using the catalyzer for clean non-woody pulping according to claim 2, characterized in that a submerged mesh is arranged on the bath for the feed preparation and impurities removing.

4. The process for using the catalyzer for clean non-woody pulping according to claim 2, characterized in that calcium hypochlorite is used for bleaching liquor, and a supplying port of chlorine gas is added at a recycle entrance of a fan pump, through which the chlorine gas is added intermittently during the bleaching to increase available chlorine in the bleaching liquor so that the available content of bleaching liquor remains constant during the whole bleaching process.

5. The process for using the catalyzer for clean pulping according to claim 2, characterized in that said raw material is selected from the group consisting of wheat straw, rice straw, straw stem, corn stalk, cotton straw or reed.

6. A catalyzer for clean non-woody pulping comprising:

5 wt %-9 wt % of sodium salicylate;

2 wt %-5 wt % of anion silicic acid, 3 wt %-7 wt % of cooking aids;

2.1 wt %-3.7 wt % of chlorine; and balance of water;

wherein said cooking aids includes:

0.01 wt %-5 wt % of ethanol and/or ether;

0.25 wt %-35 wt % carbon tetrachloride;

0.15 wt %-30 wt % of basic $Na_2SO_3$; and balance of water.

* * * * *